US008596860B2

(12) United States Patent
Verdon et al.

(10) Patent No.: US 8,596,860 B2
(45) **Date of Patent: *Dec. 3, 2013**

(54) CASE CLOSED BY A GLASS WITH AN INVISIBLE JOINT OR ONE THAT CAN BE DECORATED AND MANUFACTURING METHODS

(75) Inventors: Christian Verdon, Boussens (CH); Stewes Bourban, Ecublens (CH); Gilles Derriey, Morteau (CH)

(73) Assignee: Montres Rado S.A., Lengnau (CH)

( * ) Notice: Subject to any disclaimer, the term of this patent is extended or adjusted under 35 U.S.C. 154(b) by 1329 days.

This patent is subject to a terminal disclaimer.

(21) Appl. No.: 11/424,046

(22) Filed: Jun. 14, 2006

(65) Prior Publication Data

US 2006/0280041 A1 Dec. 14, 2006

(30) Foreign Application Priority Data

Jun. 14, 2005 (EP) ..... 05012732

(51) Int. Cl.
*G04B 39/00* (2006.01)

(52) U.S. Cl.
USPC ..... 368/296

(58) Field of Classification Search
USPC ..... 368/296
See application file for complete search history.

(56) References Cited

U.S. PATENT DOCUMENTS

| | | | | |
|---|---|---|---|---|
| 2,716,829 | A * | 9/1955 | Huguenin et al. | 368/234 |
| 3,911,670 | A | 10/1975 | Hofer | |
| 4,435,090 | A * | 3/1984 | Jaccard | 368/32 |
| 4,623,262 | A | 11/1986 | Gogniat et al. | |
| 7,167,689 | B2 * | 1/2007 | Martin et al. | 368/296 |
| 2002/0184920 | A1 | 12/2002 | Fossaluzza | |
| 2006/0062971 | A1 | 3/2006 | Bourban et al. | |
| 2006/0280041 | A1 | 12/2006 | Verdon et al. | |

FOREIGN PATENT DOCUMENTS

| | | |
|---|---|---|
| AU | 769373 | 3/2001 |
| EP | 1 079 325 | 2/2001 |
| EP | 1 122 620 | 8/2001 |
| EP | 1 207 439 | 5/2002 |
| EP | 1 457 865 | 9/2004 |
| FR | 2 750 419 | 1/1998 |

OTHER PUBLICATIONS

European Search Report issued in corresponding application No. EP 05 01 2732 completed Apr. 13, 2006.

http://machaut.uchicago.edu/?action=search&word=bezel &resource=Webster%27s&quicksearch=on, downloaded May 9, 2011, 1 page.

(Continued)

*Primary Examiner* — R S Luebke
*Assistant Examiner* — Jason Collins
(74) *Attorney, Agent, or Firm* — Griffin & Szipl, P.C.

(57) ABSTRACT

The case includes a middle part (3) and a back cover (5) delimiting a compartment (7) closed by a glass (10), made of a transparent material resistant to temperatures above 500° C., said glass being bonded or welded at joint zones (15) at least partially covering the shoulder (4) of the middle part (3). It is characterized in that the inner face (11) of the glass (10) includes an enamel deposition (20) formed on the zones of the joints (15) with the shoulder (4) of the middle part (3), either in a hollow (14), or on the surface of said inner face (11).

27 Claims, 3 Drawing Sheets

(56) References Cited

OTHER PUBLICATIONS

Zebra Elastomeric Connectors, at http://www.fujipoly.com/products/zebra-elastomeric-connectors.html, downloaded Apr. 5, 2011, 2 pages.

Zebra, Elastomeric Connectors, at http://www.tradekorea.com/e-catalogue/union21/product-detail/P00 . . . , downloaded Apr. 5, 2011, 2 pages.

Notice of Allowance issued in related U.S. Appl. No. 11/423,539 dated Dec. 21, 2009.

* cited by examiner

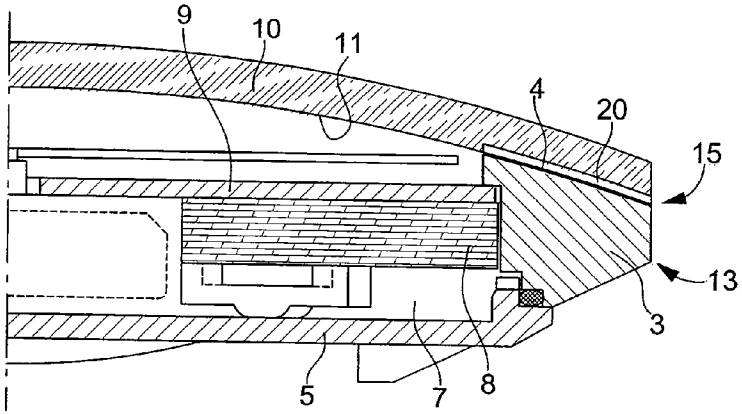
Fig. 2
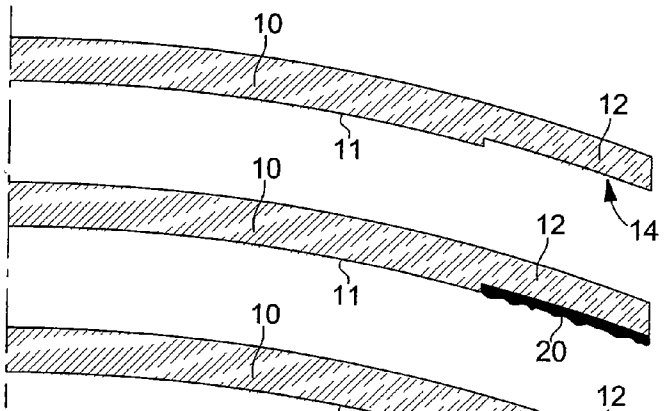
Fig. 2A
Fig. 2B
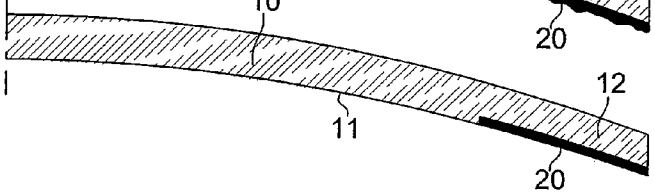
Fig. 2C
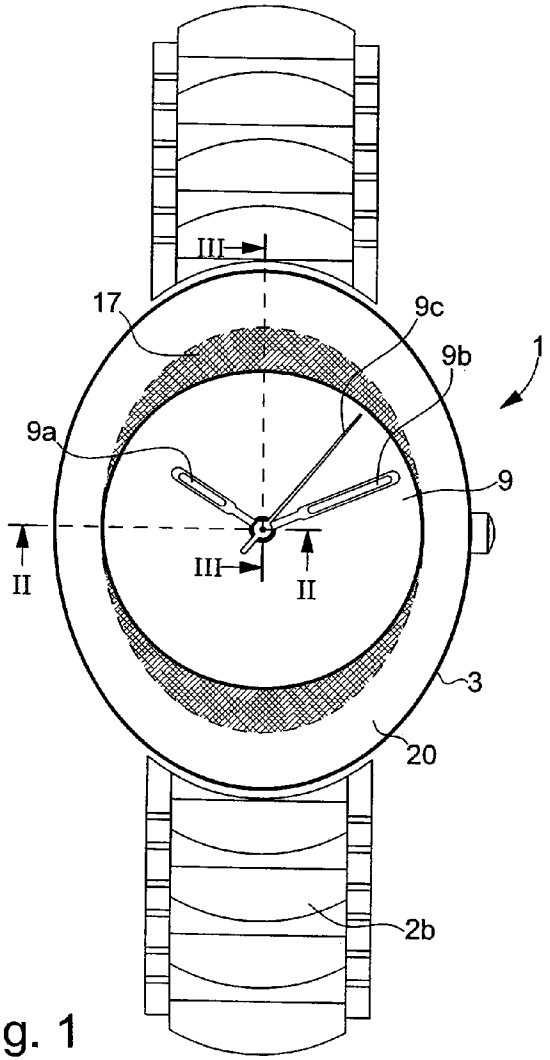
Fig. 1

CASE CLOSED BY A GLASS WITH AN INVISIBLE JOINT OR ONE THAT CAN BE DECORATED AND MANUFACTURING METHODS

This application claims priority from European Patent Application No. 05012732.3, filed Jun. 14, 2005, the entire disclosure of which is incorporated herein by reference.

FIELD OF THE INVENTION

The present invention concerns a sealed case closed by a bonded or welded glass, in an arrangement that enables the joint to be made invisible and/or a decorative effect to be obtained. The invention concerns more specifically the case of a timepiece wherein the glass, which forms the protective element for the subjacent displays, should not be detrimental to the overall aesthetic appearance, or conversely should participate in providing greater freedom as regards colours and hues.

BACKGROUND OF THE INVENTION

When one wishes to assemble a glass on a case, in particular for edge-to-edge assembly, i.e. without any slot for the glass, and particularly when the case is made at least partially of ceramic material in order to obtain the broadest possible palette of colours, the usual technique consists in metallizing the inner part of the glass in the zone where one wishes to form the joint, depositing a line of adhesive on the corresponding part of the case, then assembling the glass by pressure. The purpose of the metallizing is primarily to conceal the line of adhesive, which may have, from the start, a more or less regular contour, making it visible to the naked eye. Metallizing also enables the aging phenomena of the adhesive joint, such as shrinkage or yellowing, to be concealed. The method basically consists in depositing a primer layer, for example chromium, then by evaporating various metals (Cr, Ti, Pd, Au, . . . ) or alloys to obtain a large enough palette of shades that will all have a metallic hue. Metallizing cannot provide matte non-metallic hues, or white, which has the drawback of limiting the choice of hues for the case or its external parts.

This drawback is particularly important for cases including ceramic elements that can be manufactured in an infinite range of shades and hues but for which it is not always possible to find aesthetically appropriate metallizing.

SUMMARY OF THE INVENTION

It is therefore an object of the present invention to overcome the drawbacks of the aforecited prior art by providing a case on the aperture of which there is fixed a glass, whose joint with the shoulder of the aperture is not perceptible and which has the same hue as the case, or wherein, conversely, the joint provides an aesthetic appearance that can be altered.

The invention therefore concerns a case including a middle part and a back cover delimiting a compartment formed by a glass made of a transparent material resistant to temperatures higher than 500° C., the glass being bonded or welded at joint zones at least partially covering the shoulder of the middle part, thus leaving at least one part of the middle part visible. The case is characterized in that the inner face of the glass includes an enamel deposition in the joint zones, enabling the glass to be assembled on the shoulder of the middle part by bonding, by applying a film or dots of adhesive, or by welding.

The transparent material resistant to temperatures higher than 500° C. can be a mono or polycrystalline material, for example, quartz, spinelle or corundum, particularly sapphire. An amorphous material could also be used, such as a mineral glass provided that its softening point is higher than the temperature necessary for carrying out the enamel deposition.

According to one aspect of the invention, it is possible to choose, within a large colour chart, an enamel hue that is perfectly suited to the hue of the middle part so as to make the hue of the joint zones indistinguishable from that of the middle part, which would not be possible with the prior metallizing technique.

According to another aspect of the invention, it is possible, conversely, via an appropriate choice of various enamel hues in the joint zones, and particularly when the latter are separated, to have greater decorative freedom, as regards both hues and the shapes visible on the middle part.

According to yet another aspect of the invention, deposition of an enamel layer on a glass made of a material of a close chemical nature allows very strong adhesion of the enamel layer, practically eliminating any risk of it being torn off after bonding or welding.

According to yet another aspect of the invention, the material used to form the middle part is a ceramic material, i.e. a material having the same palette of hues and shades as enamel.

According to yet another aspect of the invention, the compartment of the case contains a timepiece movement and a dial to form a timepiece, such as a wristwatch.

According to yet another aspect of the invention, the methods implemented to carry out the enamel depositions on the joint zones allow the zones to be precisely delimited, and layers of enamel of different hues to be deposited selectively, if desired. The enamel depositions can be carried out in hollows arranged in the edge of the glass, with levelling being achieved by subsequent polishing. The enamel depositions can also be carried out on top, by direct deposition or by chemical structuring, particularly when the edge of the glass is thin.

BRIEF DESCRIPTION OF THE DRAWINGS

Other features and advantages of the present invention will appear in the following description illustrated by a wristwatch in several embodiments given by way of non-limiting illustration with reference to the annexed drawings, in which:

FIG. 1 shows a top view of a wristwatch;

FIG. 2 shows a semi cross-section along the line II-II of FIG. 1;

FIGS. 2A, 2B and 2C show the various steps of a first manufacturing method;

DETAILED DESCRIPTION OF THE INVENTION

Figure 3:
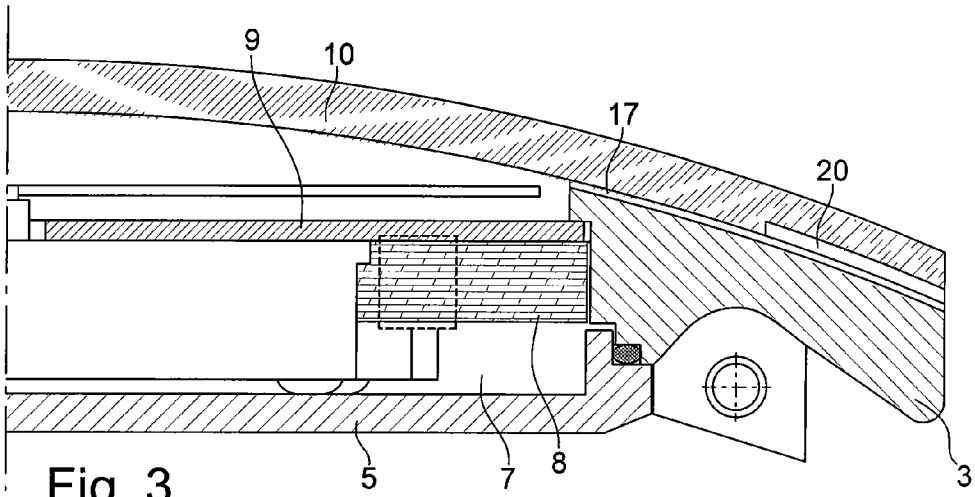
FIG. 3 shows a semi cross-section along the line III-III of FIG. 1.

In the following description the case of a wristwatch has been used as an example case.

Referring first of all to FIGS. 1, 2 and 2A to 2C, a first embodiment according to a first method will be described hereinafter.

The wristwatch shown in FIGS. 1 and 2 includes in a known manner a case 1 formed of a middle part 3, closed in its lower part by a back cover 5, and in its higher part by a glass 10 delimiting a sealed compartment 7. Compartment 7 houses a watch movement 8 for displaying time data on a dial 9. In the example shown, the display is an analogue display by means on hour hand 9*a*, a minute hand 9*b* and a second hand 9*c*.

As can be seen in FIG. 2, middle part 3 defines an outer edge 13 of the case 1 and the shoulder 4, and glass 10 extends to the outer edge 13. Glass 10 entirely covers shoulder 4 of middle part 3 to which it is bonded or welded at joint zones 15 formed by an enamel deposition 20 formed on inner face 11 of glass 10 at its external edge 12, in this example covering all of shoulder 4 of middle part 3. The hue visible to an observer through glass 10 at shoulder 4 of middle part 3 is thus the hue of enamel layer 20. When the middle part is made of ceramic material, or has an external part made of ceramic material, it is thus very easy to find exactly the same hue of enamel such that the joint zone is not perceptible to an observer.

FIGS. 2A to 2C show schematically the manufacturing steps according to a first method, more particularly suited to a glass 10 with quite a thick external edge 12. The method consists in mechanically structuring the joint zone.

In a first step (FIG. 2A), a hollow 14 is made in the external edge 12 of glass 10 by means of a diamond grinding-wheel over a depth comprised for example between 0.1 and 0.5 mm.

In a second step (FIG. 2B), an enamel deposition 20 is carried out in one or several steps via known dipping, buffing, spraying or screen printing techniques, each step being followed by firing to obtain a slightly greater thickness than the desired final thickness.

In a third step (FIG. 2C), the glass is reworked and polished by conventional means so as to eliminate any surplus or overspill of enamel and to machine the sides to achieve a well defined geometry, as regards both the enamel filling and external edge 12.

In a last step, shown in FIG. 2, glass 10 is applied to shoulder 4 of middle part 3 with the insertion of a film of adhesive (not shown). If assembly by welding is chosen, the joint zone is metallized beforehand.

FIG. 3 shows in cross-section a variant wherein the enamel deposition is only carried out above one part of shoulder 4 of middle part 3, preferably in the form of a strip close to the edge of glass 10 in order to guarantee sealing. The parts not covered in enamel can be left as they are so that the hue of the middle part appears via transparency through the glass. These parts could, conversely, be subjected to metallizing 17 for aesthetic purposes, after having formed the enamelled zones.

Figure 4:
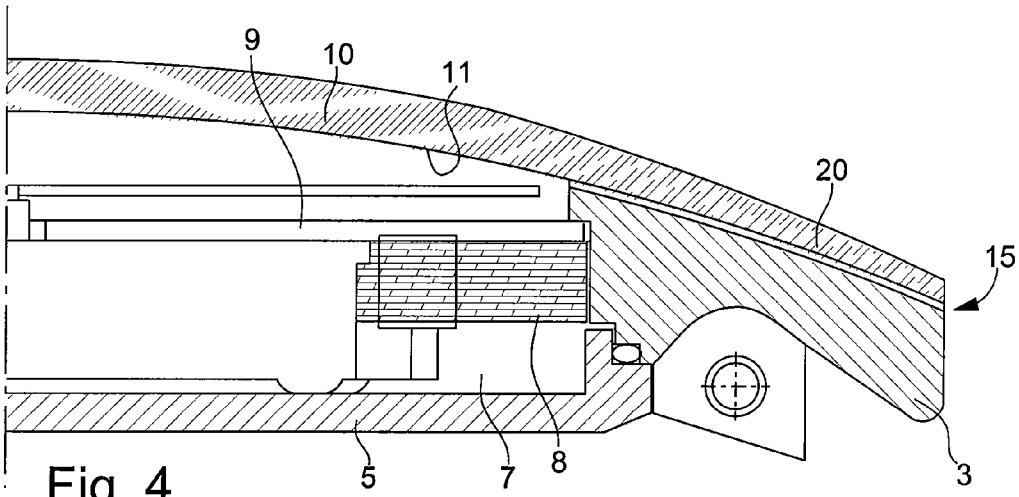
FIG. 4 shows in semi cross-section an alternative assembly of the glass on the case.
Figure 4A:
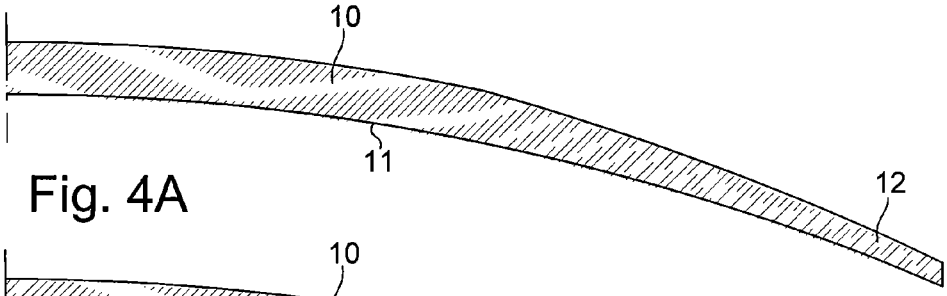
FIGS. 4A and 4*b* show the various steps of a second manufacturing method.
Figure 4B:
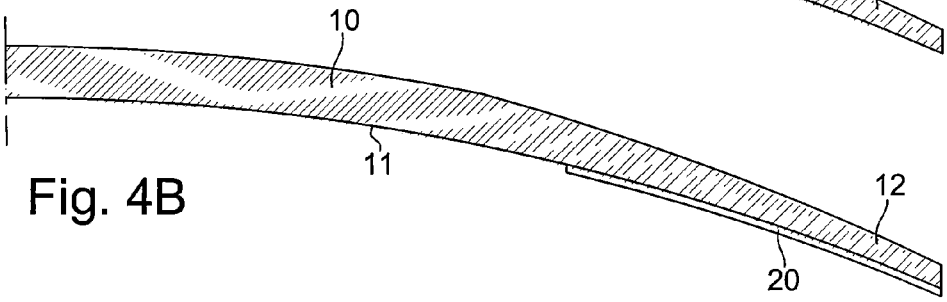

Referring now to FIGS. 4, 4A and 4B, a second embodiment will be described in accordance with a second method more particularly suited to a glass 10 whose external edge 12 is thin and in which a hollow cannot be machined. The addition of enamel 20 in joint zone 15 on inner face 11 of glass 10 can be carried out by a direct structured deposition, as shown in FIGS. 4A and 4B. The deposition of the enamel powder can be carried out by conventional pad or screen printing techniques, in several steps with firing after each step, until the desired thickness is obtained, comprised for example between 0.1 and 0.5 mm. The glass is assembled on the middle part as previously by applying a film of adhesive on shoulder 4 of middle part 3, or by welding.

Figures 5A, 5B, 5C, 5D, 5E, 5F, 5G:
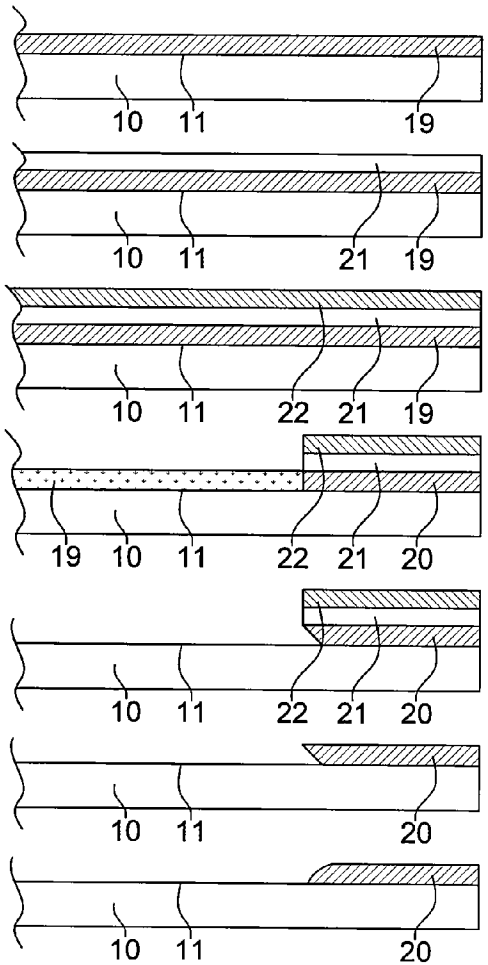
FIGS. 5A to 5G show the various steps of a third manufacturing method.

When the glass used is made of sapphire, it is also possible to carry out structuration by chemical means via photolithographic means of the type used for manufacturing MEMS on a glass substrate. The method, schematised in FIGS. 5A to 5G basically consists in the following steps:

- depositing over the entire inner surface 11 of glass 10, for example by screen printing, a layer of enamel 19 in one or several steps as previously indicated until a thickness, comprised for example between 0.1 and 0.5 mm, is obtained. This step may be followed by polishing or mechanical lapping to ensure a constant thickness (FIG. 5A);
- depositing over the entire surface of enamel 19 a chromium and gold mask 21 via known vapour deposition or sputtering techniques (FIG. 5B), over a thickness of approximately 100 to 500 nm;
- depositing a uniform layer of photoresist 22 over the entire surface of mask 21 (FIG. 5C);
- structuring mask 21 by UV radiation and removing the non-polymerised photoresist (FIG. 5D);
- etching the enamel with HF or BHF acid (FIG. 5E), ensuring that the sapphire glass is not, or only very slightly etched;
- cleaning off the residual mask 21 above the zones including enamel deposition 20 provided for the joint zones (FIG. 5F); and
- if necessary after cleaning off mask 21, stabilising the enamel deposition by reheating in a furnace (FIG. 5G).

FIGS. 5A to 5G illustrate the example of a flat glass, but it is clear that the same method could be applied to a convex glass.

Figure 6:
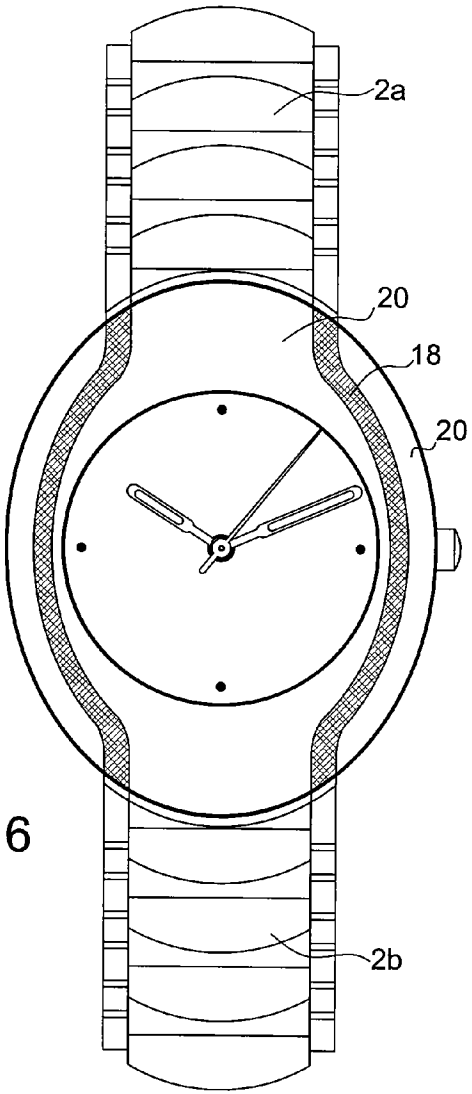
FIG. 6 shows a top view of a wristwatch made in accordance with a variant of the manufacturing methods.

This method has the advantage of giving great freedom as regards the shapes of the joint zones. Before the first step of the method, it is for example possible, as shown in FIG. 6, to carry out a partial metallization 18 inside the part of glass 10 that has to be positioned above shoulder 4 of middle part 3. Structuring then allows enamel deposition 20 to be carried out in the non-metallized parts.

According a variant, by using transluced-enamel, the deposition can be carried out on the entire shoulder leaving the metallized parts to appear by transparency.

In the example shown, the metallized parts form two threads giving an impression of continuity with the external edges of metal wristband strands 2*a*, 2*b*, and the hue of the enamelled parts is in harmony with the ceramic wristband strands.

The examples that have just been given could be subject to numerous variants available to those skilled in the art without departing from the scope of the invention. It is for example possible to alter the aesthetic appearance of the wristwatch at will by using several enamel hues for the joint zones. In the entire preceding description, the invention was illustrated by a glass mounted without a glass snap. It is clear that the technique according to the invention could also apply to a glass mounted in a conventional manner on a joint favouring the decorative appearance.

Likewise, the invention is not limited to a timepiece: it could for example find application in the manufacture of the cover of a jewellery box.

What is claimed is:

1. A sealed case comprising:

a middle part having a shoulder having a given hue;

a back cover delimiting a compartment; and a glass closing the compartment, the glass having an outer face and an inner face and comprising a transparent material resistant to temperatures above 500° C., wherein the glass is bonded or welded at joint zones at least partially covering the shoulder of the middle part, wherein the inner face of the glass includes an enamel deposition having a desired final thickness formed in the joint zones, and the enamel deposition is disposed to conceal the joint zones.

2. The case according to claim 1, wherein the glass includes a thick edge in the inner face of which a hollow is formed, whose top depth matches the desired final thickness of the enamel deposition.

3. The case according to claim 2, wherein the compartment of the case contains a timepiece movement and a dial to form a timepiece.

4. The case according to claim 1, wherein the enamel deposition is formed on top of the inner face of the glass at the joint zones, thereby delimiting uncovered glass portions outside said joint zones.

5. The case according to claim 4, wherein the compartment of the case contains a timepiece movement and a dial to form a timepiece.

6. The case according to claim 1, wherein the joint zones are continuous and cover the whole of the shoulder of the middle part.

7. The case according to claim 6, wherein the compartment of the case contains a timepiece movement and a dial to form a timepiece.

8. The case according to claim 1, wherein the joint zones are discontinuous, the glass portions located outside said zones also being able to include a metallization.

9. The case according to claim 8, wherein the compartment of the case contains a timepiece movement and a dial to form a timepiece.

10. The case according to claim 1, wherein the enamel deposition on the inner face of the glass is carried out over a partial metallization of said inner face.

11. The case according to claim 10, wherein the compartment of the case contains a timepiece movement and a dial to form a timepiece.

12. The case according to claim 1, wherein the middle part is made of ceramic material, or includes a ceramic external part.

13. The case according to claim 12, wherein the compartment of the case contains a timepiece movement and a dial to form a timepiece.

14. The case according to claim 1, wherein the transparent material forming the glass is a mono or polycrystalline material selected from the group consisting of quartz, spinelle and corundum.

15. The case according to claim 14, wherein the material forming the glass is a sapphire.

16. The case according to claim 15, wherein the compartment of the case contains a timepiece movement and a dial to form a timepiece.

17. The case according to claim 14, wherein the compartment of the case contains a timepiece movement and a dial to form a timepiece.

18. The case according to claim 1, wherein the transparent material forming the glass is an amorphous material.

19. The case according to claim 18, wherein the compartment of the case contains a timepiece movement and a dial to form a timepiece.

20. The case according to claim 18, wherein said amorphous material is mineral glass.

21. The case according to claim 1, wherein the compartment of the case contains a timepiece movement and a dial to form the timepiece.

22. A sealed case comprising:

a middle part having a shoulder having a given hue;

a back cover delimiting a compartment; and a glass closing the compartment, the glass having an outer face and an inner face and comprising a transparent material resistant to temperatures above 500° C., wherein the glass is bonded or welded at joint zones at least partially covering the shoulder of the middle part, wherein the inner face of the glass includes an enamel deposition having a desired final thickness formed in the joint zones, wherein the enamel deposition is disposed to conceal the joint zones, and wherein the enamel deposition has the same hue as that of said shoulder of the middle part.

23. The case according to claim 22, wherein the compartment of the case contains a timepiece movement and a dial to form a timepiece.

24. A method of manufacturing a sealed case including a middle part and a back cover delimiting a compartment closed by a glass made of a transparent material resistant to temperatures above 500° C., said glass having an outer face, an inner face, and an edge, wherein the method includes the steps of:

(a) machining a hollow in the inner face of the glass close to the edge;

(b) carrying out an enamel deposition having a slightly greater thickness than the desired final thickness in one or several steps to form an enamel front surface parallel to the inner surface of the glass; and (c) machining the enamel deposition to form an enamel front surface parallel to the inner face of the glass and an enamel side surface substantially perpendicular to the inner face of the glass.

25. A sealed case comprising:

a middle part having a shoulder having a given hue, a back cover delimiting a compartment, and a glass closing the compartment, the glass having an outer face, an inner face and an external edge and comprising a transparent material resistant to temperatures above 500° C., wherein the glass is bonded or welded at joint zones at least partially covering the shoulder of the middle part, wherein the inner face of the glass includes an enamel deposition having a desired final thickness formed in the joint zones, the enamel deposition at least covering a strip at the external edge of the glass to guarantee sealing.

26. A sealed case comprising:

a middle part having a shoulder having a given hue, wherein the middle part defines an outer edge of the case and the shoulder extends to the outer edge;

a back cover delimiting a compartment; and a glass closing the compartment, the glass having an outer face and an inner face and comprising a transparent material resistant to temperatures above 500° C., wherein the glass is bonded or welded at joint zones at least partially covering the shoulder of the middle part, wherein the inner face of the glass includes an enamel deposition having a desired final thickness formed in the joint zones, and the enamel deposition is disposed to conceal the joint zones.

27. A sealed case comprising:

a middle part having a shoulder having a given hue, wherein the middle part defines an outer edge of the case and the shoulder extends to the outer edge;

a back cover delimiting a compartment; and a glass closing the compartment, the glass having an outer face and an inner face and comprising a transparent material resistant to temperatures above 500° C., wherein the glass is bonded or welded at joint zones at least partially covering the shoulder of the middle part, wherein the inner face of the glass includes an enamel deposition having a desired final thickness formed in the joint zones, wherein the enamel deposition is disposed to conceal the joint zones, and wherein the enamel deposition has the same hue as that of said shoulder of the middle part.

* * * * *